US005287820A

United States Patent [19]

Stutznäcker

[11] Patent Number: 5,287,820

[45] Date of Patent: Feb. 22, 1994

[54] MOVABLE AND RELATIVELY POSITIONABLE SEWING UNITS FOR SEWING STATIONARY MATERIAL

[75] Inventor: Klaus Stutznäcker, Frechen, Fed. Rep. of Germany

[73] Assignee: Nahmaschinenfabrik Emil Stutznacker GmbH & Co., KG, Fed. Rep. of Germany

[21] Appl. No.: 878,123

[22] Filed: May 4, 1992

[30] Foreign Application Priority Data

May 2, 1991 [DE] Fed. Rep. of Germany ..... 4114148
Aug. 27, 1991 [DE] Fed. Rep. of Germany ..... 4128336

[51] Int. Cl.[5] ..... D05B 11/00; D05B 21/00

[52] U.S. Cl. ..... 112/117; 112/121.74

[58] Field of Search ..... 112/2, 2.1, 9, 117, 112/118, 119, 121.12, 121.13, 121.23, , 217.1, 217.2, 303, 121.11, 121.15, 121.14, 266.1

[56] References Cited

U.S. PATENT DOCUMENTS

| | | | |
|---|---|---|---|
| 2,501,240 | 3/1950 | Schwartz | 112/118 |
| 3,649,412 | 3/1972 | Foggo | 112/2 X |
| 3,749,037 | 7/1973 | Cash | 112/117 |
| 3,960,095 | 6/1976 | Story | 112/118 |
| 4,601,249 | 7/1986 | Frye | 112/121.14 |
| 4,669,405 | 6/1987 | Resta et al. | 112/119 X |
| 4,858,540 | 8/1989 | Resta et al. | 112/117 |
| 4,969,410 | 11/1990 | Brower et al. | 112/117 X |
| 5,040,473 | 8/1991 | Zesch et al. | 112/118 X |
| 5,103,747 | 4/1992 | Resta et al. | 112/117 |

FOREIGN PATENT DOCUMENTS

| | | | |
|---|---|---|---|
| 0316267 | 5/1989 | European Pat. Off. | 112/117 |
| 1660880 | 2/1967 | Fed. Rep. of Germany . | |
| 3332421 | 9/1983 | Fed. Rep. of Germany . | |
| 3534988 | 10/1985 | Fed. Rep. of Germany . | |
| 1-01591 | 1/1989 | Japan | 112/118 |

*Primary Examiner*—Clifford D. Crowder
*Assistant Examiner*—Ismael Izaguirre
*Attorney, Agent, or Firm*—Diller, Ramik & Wight

[57] ABSTRACT

A sewing machine for sewing stationary large surface material (13) includes at least two units (14, 16 and 15, 17) of which includes a sewing head (14, 15) and an associated shuttle box (16, 17) which are displaceably mounted for movement in the first (x) and second (y) directions substantially normal to each other. A common drive mechanism (18, 19, etc.) displaces the unit simultaneously in the first direction (x) while spaced a predetermined distance (D) from each other while an associated disengaging mechanism (35) can controllably disengage one of the units (14, 16 or 15, 17) from the common drive (18, 19, etc.) while the other unit is displaced by the common drive to thereby change the predetermined distance (D) after which the one unit is re-engaged. Preferably holding mechanisms are provided for holding the disengaged sewing head (14 or 15) and the disengaged shuttle box (16, 17) of the disengaged one of the units (14, 16 or 15, 17) substantially stationary during the displacement of the other unit, and preferably the stationary unit is maintained substantially stationary at a parked position (38) during the displacement of the other unit.

41 Claims, 6 Drawing Sheets

MOVABLE AND RELATIVELY POSITIONABLE SEWING UNITS FOR SEWING STATIONARY MATERIAL

BACKGROUND OF THE INVENTION

1. Field of the Invention

The invention concerns a sewing machine for large-surface, stationary material such as quilts, comprising at least two units each including a sewing head and associated shuttle box, each unit being displaceable on an arch-frame in the x-direction and the arch-frame itself being displaceable in the y-direction.

2. Description of the Related Art

Sewing machines of the above species are already known. In particular they are stitching machines for large-surface materials which are at rest during stitching, the sewing head(s) as well as the shuttle boxes being displaceable in two mutually orthogonal directions, the x- and y-directions, in the plane of the material, in order to produce the stitching paths above or below the material. The sewing member(s) is (are) located on an arch-frame, that is the sewing heads together with the needle drive are mounted on the upper arch-frame crossbeam and the shuttle box(es) together with the shuttle drive on the lower crossbeam. During sewing, the entire arch-frame can be moved at will forward and back in one direction, the y-direction. The sewing member(s) on the arch-frame can be moved in another direction, namely at 90° to the arch-frame displacement, namely in the x-direction. The drive and control concerning the x- and y-directions are implemented in known manner by electrical or electronic means in turn so controlling motors for the x- and y-directions that the resulting motion of the sewing members corresponds to the stitching path. When two or more sewing members are mounted on the arch-frame and are displaced as described, two or more parallel seams spaced apart by the distance between the sewing members are obtained.

Two or more sewing members are desired in such sewing machines because the sewing or stitching as a whole can be substantially accelerated and the products are thus made in a correspondingly shorter time, there being comparatively little increase in equipment on account of the several sewing members in relation to the overall machine. The sewing members mentioned herein are hereafter called sewing units for the sake of simplicity and comprise each of a sewing head with needle drive and of a shuttle box with shuttle drive. The basic problem which must be kept in mind is that the sewing head and the shuttle box always must be made to move accurately relative to each other in terms of fractions of a mm, for instance with 0.1 mm accuracy, as otherwise there may be collisions between the needle and the shuttles.

As regards sewing machines with two or more sewing members or units, there is a particular problem when selecting a new stitching pattern and hence when the spacing between the sewing members must be changed. In the light of the required accuracy, such a change in spacing even where only two sewing members are involved will entail substantial and very time-consuming labor of conversion and adjustment.

SUMMARY OF THE INVENTION

Accordingly, it is the object of the invention to create a sewing machine making it possible to convert to a new sewing program in the shortest possible time with the greatest accuracy.

In accordance with the invention one unit can be disengaged from a common drive and can be fixed in a precisely defined parked or parking position, for the purpose of changing the spacing between the units, and the other unit can be moved by means of the common drive into the desired new distance position, and the unit in the parking position can then be re-engaged.

As a result a substantial advantage is achieved because the precisely defined parking position is sensed by the control or control computer and thereupon the remaining sewing member(s) or unit(s) can be moved in controlled manner relative to the unit in the parked position.

In further accordance with the invention a particular unit can be disengaged from the common drive and is freely displaceable for the purpose of changing the inter-unit distance by adjustment to the newly selected distance in relation to a pattern of the drive pitch and can be re-engaged.

A substantial advantage is achieved because the sewing heads and the associated shuttle boxes can be arbitrarily displaced and independently spaced from each other after disengagement from the common drive and then can be re-engaged. Because the common drive comprises a scale, the accuracy of this scale can be used to move the sewing heads and the associated shuttle boxes into a mutually accurate position so that there shall be no need for later fine-adjustment between the sewing heads and the shuttle boxes. Accordingly it is enough to displace the particular sewing head and the associated shuttle box along the scale graduations. Upon engaging, or re-engaging, the accuracy of the scale and of the total common drive ensures adequately accurate mutual adjustment between the sewing heads and the shuttle boxes. Advantageously too, each arbitrary desired number of sewing heads and shuttle boxes may be combined, as a result of which sewing can be accelerated as a whole. Converting to a new sewing program also is simplified thereby.

The design of the sewing machine of the invention cited above also may be such that in order to change the distances between the units, one unit always can be disengaged from the common drive and can be freely displaceable and, according to a scale on the drive, it can be adjusted for the newly selected distance and can be re-engaged.

In another embodiment of the invention, at least one unit can be disengaged from a common drive and can be fixed in position in the x-direction for the purpose of changing the inter-unit distance, and other unit can be moved in a controlled manner by the common drive into a new position which is the desired distance from the affixed unit, and the distance position is measured by a distance sensor and this unit shall be re-engaged to the common drive when it arrives at the new distance position.

The drawing schematically shows illustrative embodiment modes of the invention.

DESCRIPTION OF THE PREFERRED EMBODIMENTS

Figure 1:
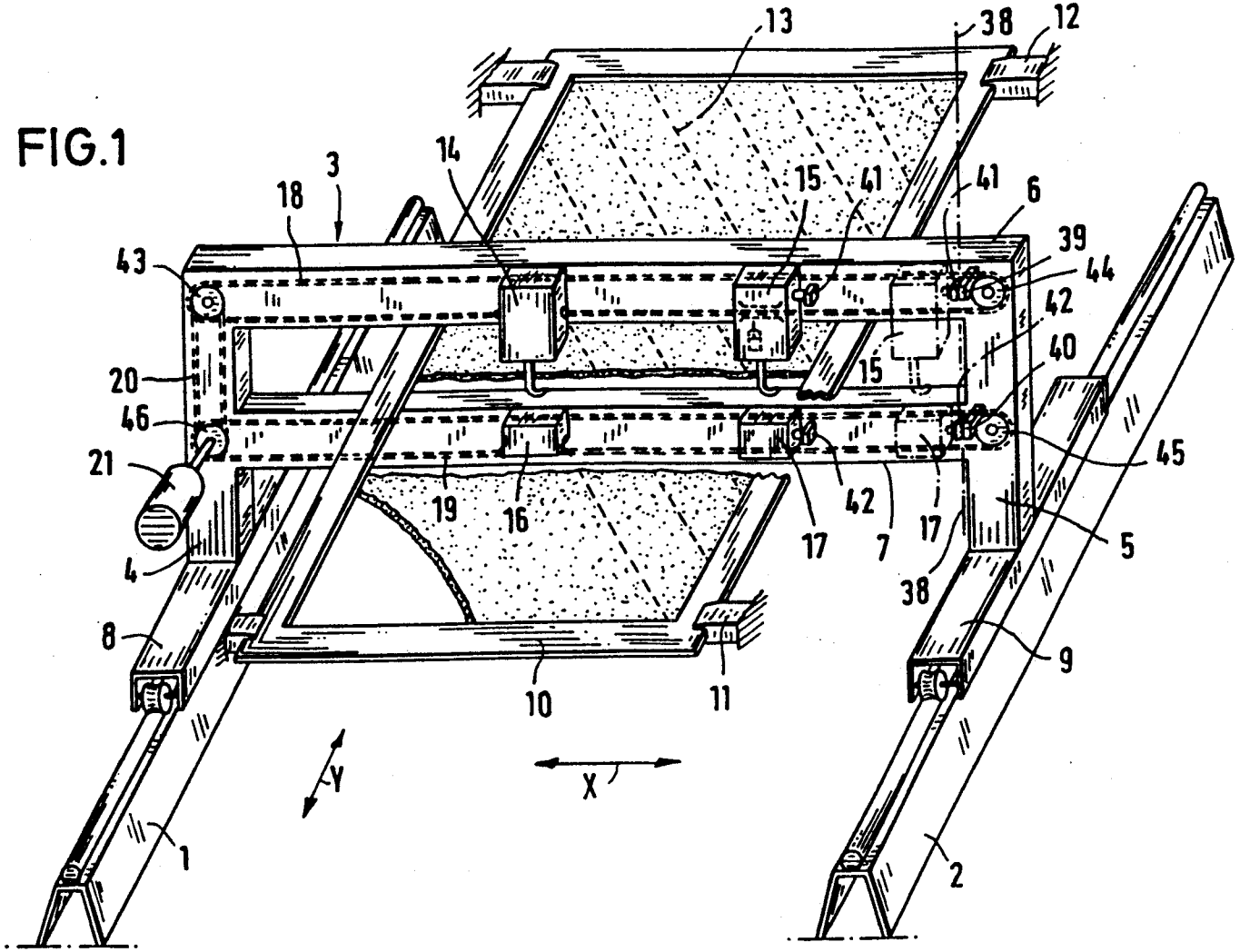
FIG. 1 is a perspective of the overall sewing machine shown in simplified form.

FIG. 1 is a simplified perspective view of an illustrative embodiment of the sewing machine of the invention. An arch-frame 3 rests in displaceable manner in the y-direction on stationary rails 1 and 2 by an omitted motor and control means. Essentially the arch-frame 3 consists of two side posts 4 and 5 connected by crossbeams 6 and 7. The arch-frame 3 rests on riding feet 8 and 9. The large-surface sewing material 13, for instance a quilt of a specific thickness shown by the cutaway edge, is held and tensioned in a frame 10 affixed in fasteners 11 and 12.

In the embodiment shown, two sewing heads 14 and 15 are located on the upper crossbeam 6 and two associated shuttle boxes 16 and 17 are present on the lower crossbeam 7. The two units, namely the sewing head 14 and the shuttle box 16 and the sewing head 15 and the shuttle box 17, are moved by a common drive. In this embodiment, the common drive comprises two endless toothed belts 18 and 19 passing at the ends of the crossbeams 6 and 7 of the arch-frame 3 around reversing toothed rollers or gears 43, 44, 45 and 46. Furthermore the two endless belts are connected by a connection belt 20 driving them jointly, it being understood that the connection belt 20, which is also an endless belt, passes around separate reversing toothed rollers (not shown) mounted coaxially with the reversing toothed rollers 43 and 46, respectively. Also a drive motor 21 is present in FIG. 1 to move the said units 14, 16; 15, 17 in the x-direction on the arch-frame 3. In this embodiment the drive motor 21 is connected to the drive shaft (unnumbered) of the reversing roller 46.

Figure 3:
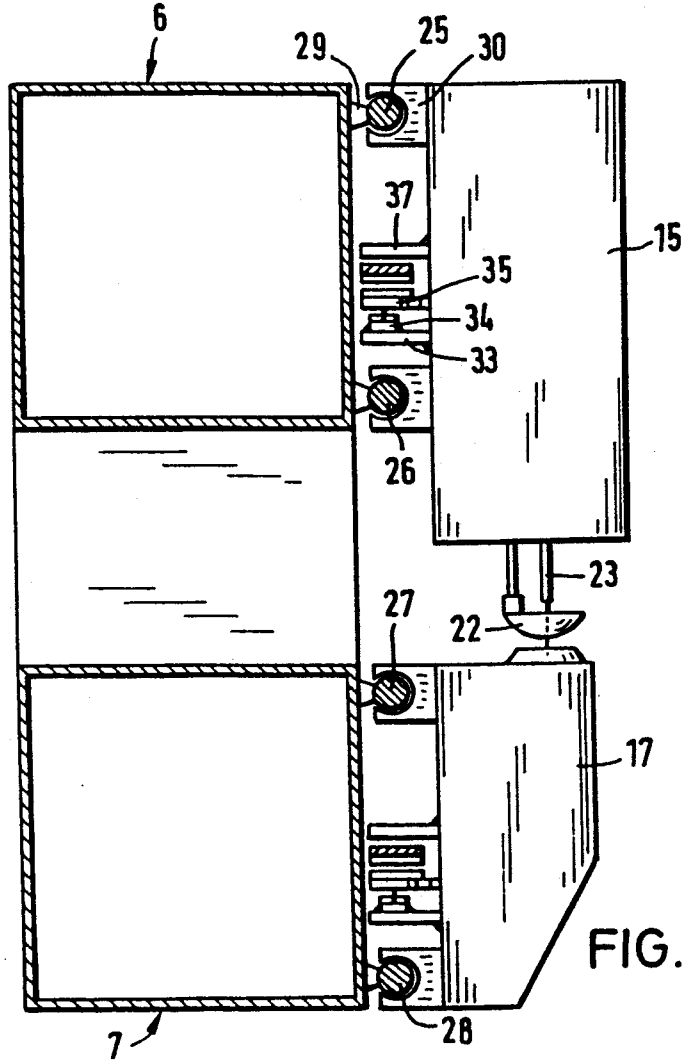
FIG. 3 is an end view of FIG. 2, partly in vertical section.
Figure 2:
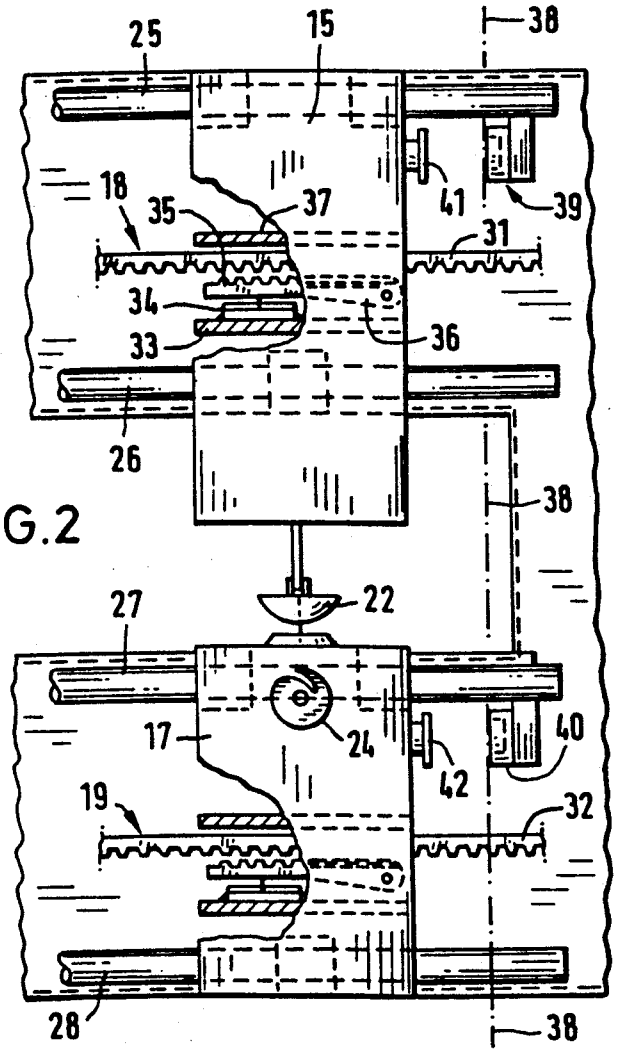
FIG. 2 is a front view of a cutaway of FIG. 1, namely of an enlarged unit partly shown in cutaway form.
Figure 5:
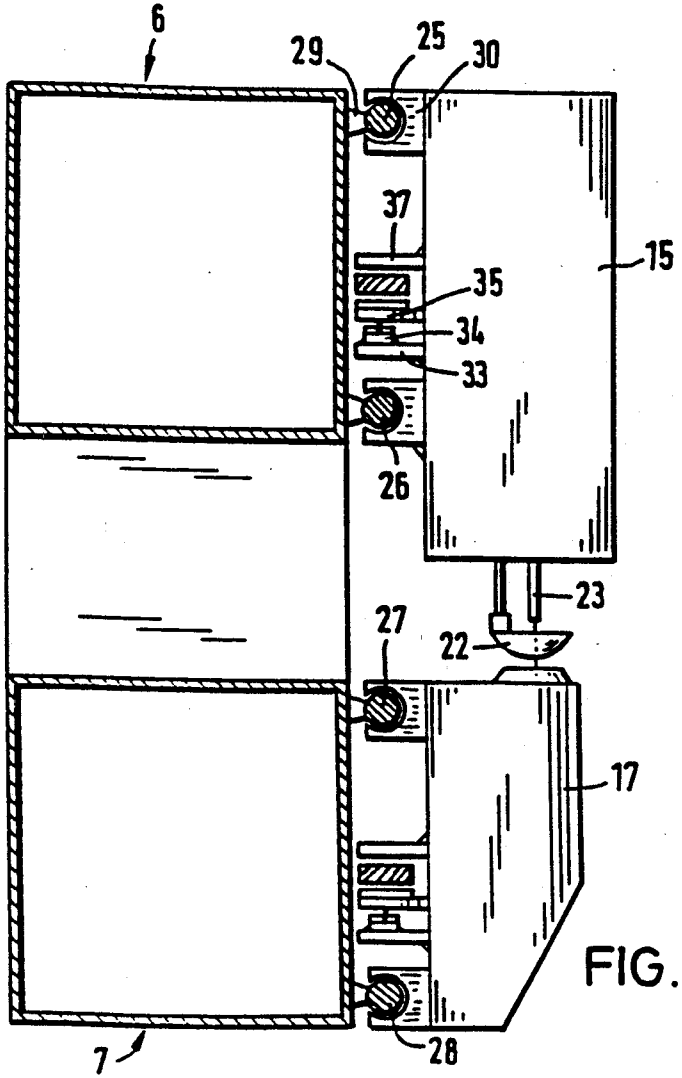
FIG. 5 is an end view relating to FIG. 4, partly in vertical section.
Figure 4:
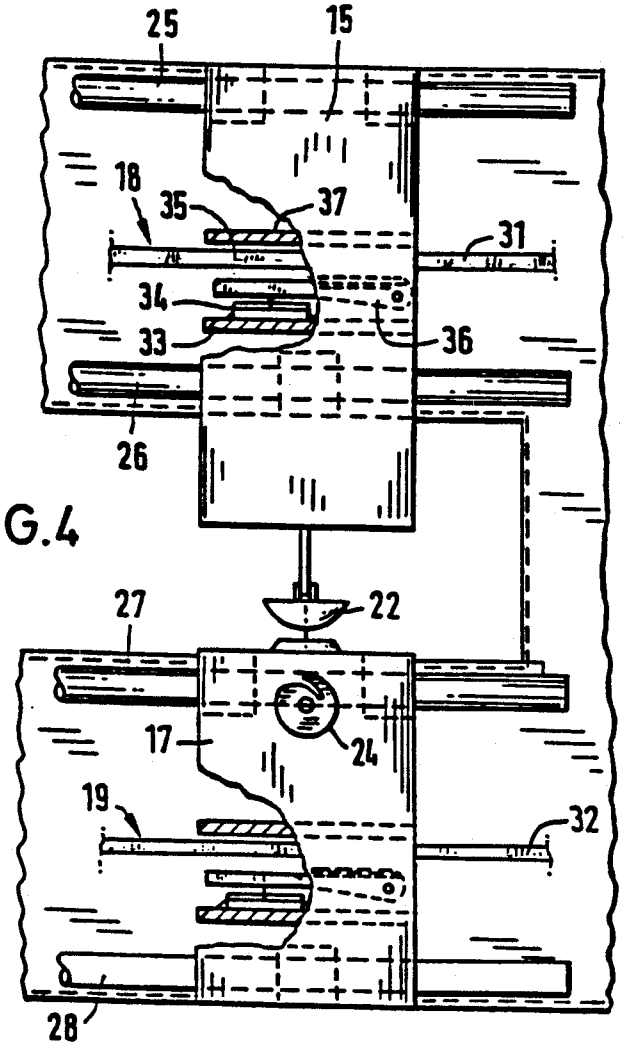
FIG. 4 is a front view of a cutaway of another sewing machine.

FIGS. 2 and 3 illustrate the precise position-matching of the sewing head 15 and of the shuttle box 17 by showing the press foot 22 (FIG. 2) and the needle clamp 23 (FIG. 3) with the needle (unnumbered) on one hand and the shuttle 24 (FIG. 2) on the other. The sewing heads 14 and 15 and the shuttle boxes 16 and 17 are guided on two guide bars 25, 26 and 27, 28, respectively, of the respective crossbeams 6 and 7 of the arch-frame 3. These guide bars 25 through 28 are linked by supports 29 (FIG. 3) to the crossbeams 6, 7 and contribute to the accurate guidance and positioning of sewing heads 14, 15 and shuttle boxes 16, 17. The connection between the guide bars 29 and the sewing heads 14, 15 as well as the shuttle boxes 16, 17 is implemented by slide pads 30 shown in FIG. 3.

The sewing heads 14, 15 and the shuttle boxes 16, 17 can be linked by a coupling to a segment or portion 31 and 32, respectively, of the endless belts 18 and 19. As shown in FIGS. 2 and 3, the coupling consists of disengaging and re-engaging means including a coupling member 35 which by means of an actuator 34 can be vertically displaced on a support plate 33, and of a matching plate 37, as a result of which a selected segment of the endless belts 18, 19 can be firmly clamped by these parts.

The endless belts 18, 19 may be smooth belts and in that case the described coupling parts may act on any side. To achieve even greater reliability against slippage during operation, the endless belts 18, 19 also may be toothed belts, as shown in the drawing. In that case the coupling member 35 will be fitted with toothing matching the toothed belts 18, 19. Moreover the coupling member 35 may be precisely adjusted in the x-direction by means of a control system 36 shown in simplified manner.

When the distance between the units 14, 16 and 15, 17 must be changed, for instance when a new sewing program must be selected, one of the units, namely, according to FIGS. 2 and 3, the sewing head 15 and the shuttle box 17, is moved into a precisely defined parked position as shown by the dot-dash line 38 of FIG. 2. This parked position 38 is determined by stationary magnetic clamps 39 and 40, in particular electromagnets, and by magnetic plates 41 and 42 at the sewing head 15 and shuttle box 17. The unit 15, 17 first is moved by the common drive 18–21 to the right until the magnetic plates 41 and 42 impact and stop against the magnetic clamps 39 and 40, as a result of which this unit 15, 17 then is retained in the parked position 38. Next the coupling or coupling members 35 are released, that is, this unit 15, 17 in the parked position 38 is disengaged from the endless belts 18, 19 of the common drive 18–20. Now the unit 14, 16 which has its coupling members engaged with the endless belts 18, 19, respectively, can be moved by the common drive 18–20 into the new position at the newly desired distance from the unit 15, 17 in the parked position 38. Once the new distance position has been reached, the unit 15, 17 in the parked position 38 can again be linked to the common drive 18–21 through the coupling members 35 and the endless belts 18, 19 and thereby the new sewing program can then be carried out.

Advantageously the described parked position 38 with the magnetic clamps 39, 40 are located near one end of the arch-frame 3, that is near the right end of FIG. 1, as indicated therein by the phantom outline of the unit 15, 17. However and in particular as regards more than two units, the parked position 38 under some circumstances also may be located at some other site of the arch-frame 3. Ilustratively, if there are three units on the arch-frame 3, the central unit first may be moved into the parked position at any suitable arch-frame location, or the units may be moved alternatingly into the parked positions in order to adjust the mutual distances.

As already mentioned above, the sewing machine is equipped with an electrical or electronic control of such design that the positions of all units 14, 16; 15, 17 can be ascertained or recorded at all times during sewing.

Be it further borne in mind that the invention is not restricted to the above preferred common drive 18–20 described above. A common drive also may be used which shall comprise two spindles parallel to the crossbeams 6, 7 of the arch-frame 3, said spindles bearing fixed nuts for the sewing heads and shuttle boxes, respectively. Those nuts of the unit in the parked position may be loosened, as a result of which these nuts revolve loosely together with the spindles without displacement. As soon as these nuts are fastened again, the common drive becomes effective again for all units.

FIGS. 4 through 8 illustrate a further embodimetn of the sewing machine of the invention. This embodiment coincides with that of FIGS. 1 through 3 as regards all identical or equivalent components identified by reference numerals 1 through 37 and 43 through 46, and accordingly the description of FIGS. 1 through 3 also applies to the embodiment of FIGS. 4 through 8. However, in FIGS. 1-3 the belts are in the form of endless smooth belts 18 and 19 and a toothed connection belt 20, and the reversing rollers are designed as reversing gears 43, 44, 45 and 46. Again separate reversing gears are provided for the smooth connection belt 20 and are mounted coaxially with the reversing gears 43 and 46.

The coupling member 35 is also smooth matching the smooth endless belts 18, 19. Moreover, the coupling member 35 can be accurately adjusted in the x-direction during first set-up by means of a control device 36 shown in simplified manner.

Figure 7:
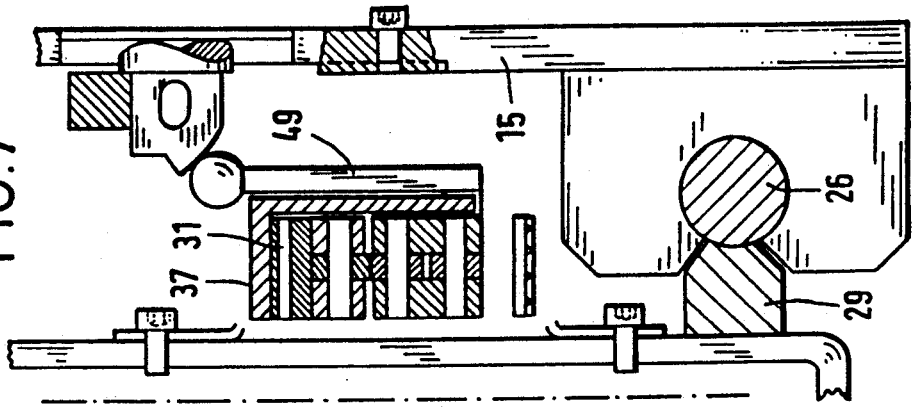
FIG. 7 is a sideview of a vertical section relating to FIG. 6.
Figure 8:
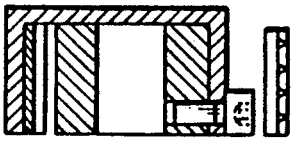
FIG. 8 is a partial vertical section of a detail elsewhere than shown in FIG. 7.
Figure 6:
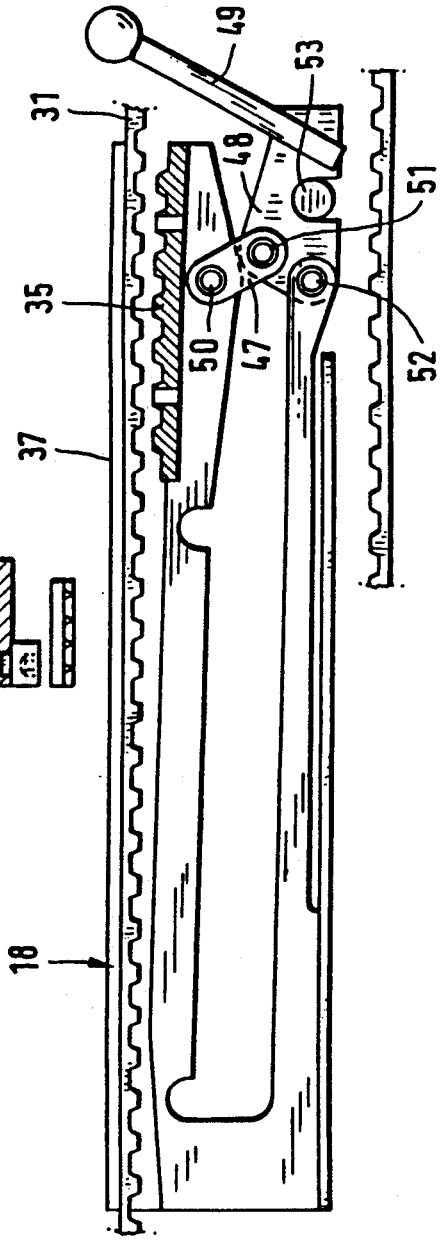
FIG. 6 is a cutaway of embodiment mode and on an enlarged scale.
Figure 6:
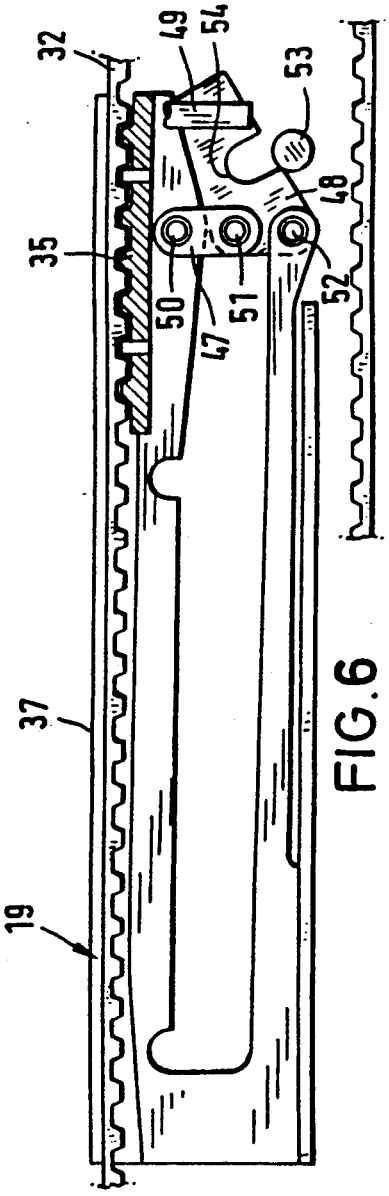
Figure 9:
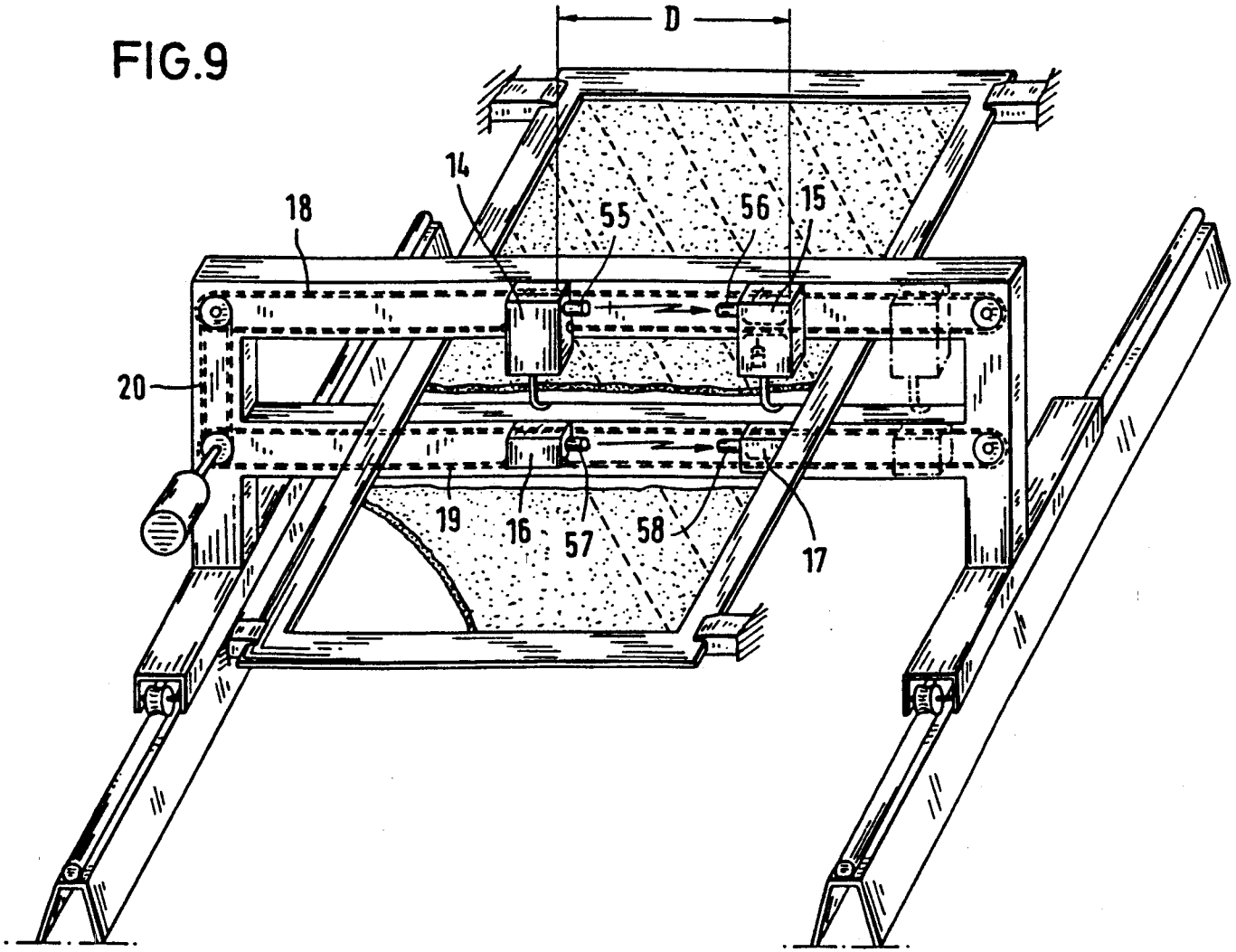
FIG. 9 is a view according to FIG. 1 but for another embodiment.
Figure 10:
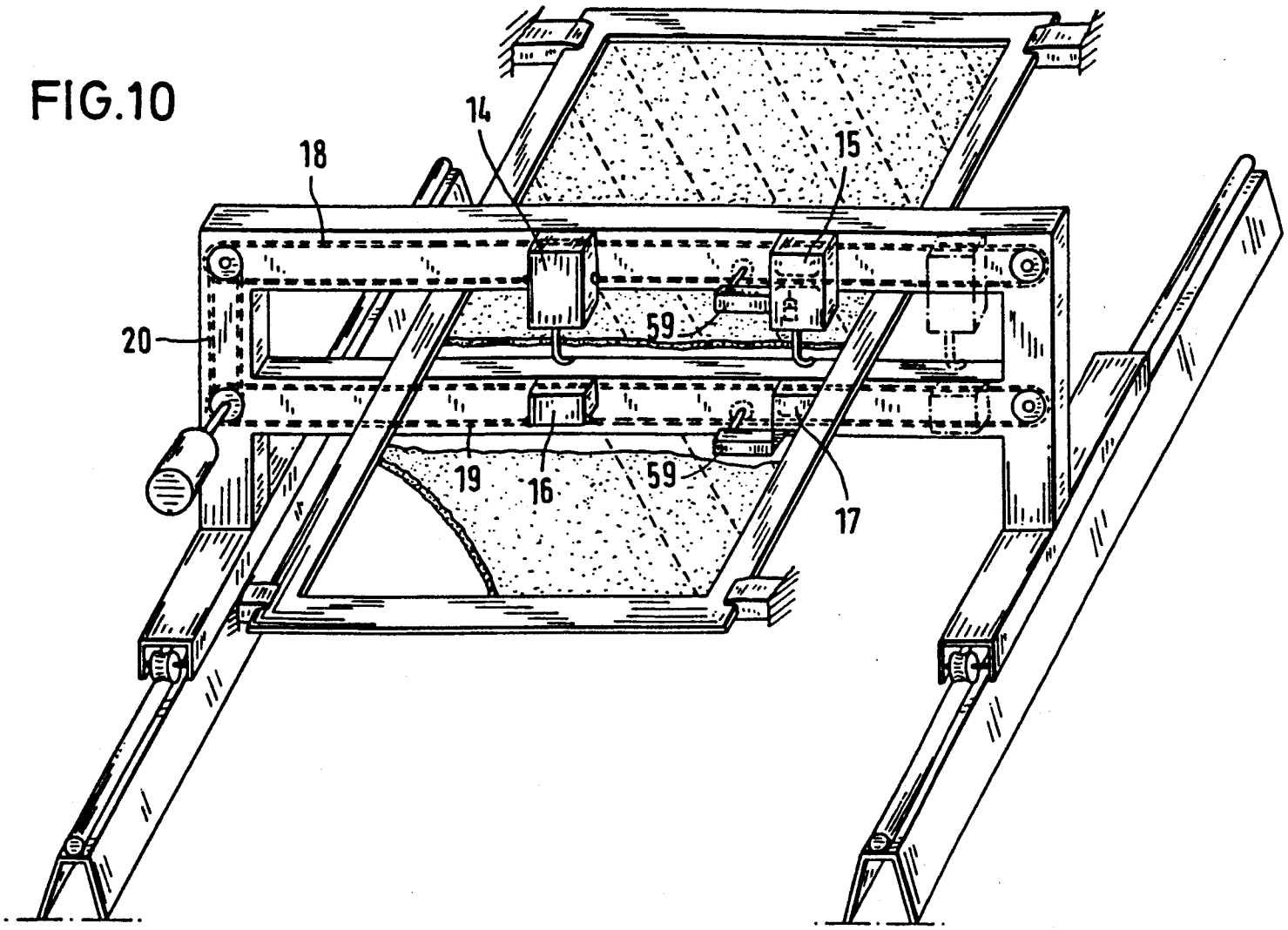
FIG. 10 is a view according to FIG. 1 but also for another embodiment.

It was already explained above that the sewing heads 14, 15 and the shuttle boxes 16, 17 can engage each by coupling a belt segment 31, 32 of the endless toothed belt 18, 19. FIGS. 8 through 10 illustrate a preferred design. Therein the actuator comprises two levers 47 and 48 pivotally connected together and to the coupling member 35. The pivots are denoted by reference numerals 50, 51 and 52. The upper part of FIG. 7 shows the operational position, wherein the coupling member 35 is disengaged from the upper segment 31 of the endless toothed belt 18. This is implemented by pivoting the lever arm 49 clockwise. The lever 48, specifically the lever part (unnumbered) extended to the right, comprises a slot or clearance 54 entered by a stop bolt 53, as a result of which the vertical displacement of the coupling member 35 is limited in the downward direction. By pivoting the lever arm 49 counter-clockwise, the coupling member 35 is moved upward and thereby its toothing engages the correspondingly selected toothing of the upper segment 31, 32 of the endless toothed belts 18, 19, respectively.

If now the distance between the units (not shown) must be changed, for instance when another sewing program is selected, then the units comprising the sewing head and the shuttle box can be disengaged from the endless toothed belts 18, 19 and then can be shifted arbitrarily. Thereupon, in the newly selected position, the sewing head and the shuttle box can be re-engaged. Because of the accurate pitch of the endless toothed belts 18, 19 accurate mutual array of sewing head and shuttle box is then easily implemented.

In order to further facilitate adjustment in practice, advantageously at least one of the two endless toothed belts 18, 19 may be fitted with a scale (not shown) so that the distance between any two units is fixed in simple manner. As an alternative to this kind of adjustment, at least one of the two crossbeams 6 and 7 is fitted with a scale in such a way that the distance between any two units again can be set in simple manner.

Another design solution relating to the drive comprises as the common drive two endless chains passing around sprocket wheels. The pitch is then determined by the chain links. This embodiment mode is not shown in the drawings, however it is easily put into practice by replacing the endless toothed belts 18, 19 with corresponding endless chains. Obviously in such a case the connection toothed belt 20 shall be replaced by a corresponding connection chain.

FIGS. 9 and 10 illustrate further embodiments of the sewing machine of the invention basically coinciding to the embodiment of FIG. 1. However, the embodiments shown in FIGS. 9 and 10 differ in that to change a distance D between the units 14, 16 and 15, 17, at least one unit can be disengaged from the common drive 18, 19, 20 and can be affixed in the x-direction. The particular other unit can be controlled by the common drive (18, 19, etc.) to move into a desired new distance position. What is especially significant in this instance is that the distance position is measured by a distance sensor. As soon as this unit has reached the new distance position, it can be re-engaged to the common drive (18, 19, etc.). In the embodiment mode of FIG. 9, the unit 14, 16 may remain rigidly joined to the common drive 18, 19, 20 whereas the other unit 15, 17 shall be disengaged from the common drive for the x-direction and shall be re-engaged to it again once the new distance position has been reached. This embodiment also applies in this sense to the design of FIG. 10.

Now FIG. 9 shows the feature that the distance sensor consists of two transmitters 55 and 57 and two receivers 56, 58 which, as shown in the drawing, are mounted to the particular sewing heads 14 and 15 and to the shuttle boxes 16, 17. These distance sensors may be designed as ultrasonic or laser sensors. Such distance sensors are known from other engineering fields and are commerically available, and therefore their technical details need not be described here.

FIG. 10 illustrates another design of distance sensors which are mounted to the unit to be adjusted, for instance the unit of sewing head 15 and shuttle box 17, and such distance sensors are in the form of rotary displacement pickups 59 constantly engaging the common drive 18, 19, 20. These rotary displacement pickups may be in the form of so-called resolvers or as incremental or absolute shaft encoders. These displacement pickups 59 comprise wheels constantly engaging in slip-free manner the particular drive belt for the displacement in x-axis. The wheels may be gears which in that case engage corresponding endless toothed belts. These displacement pickups remain engaged with the endless belts even when the associated sewing head 15 and the shuttle box 17 are disengaged from the particular drive means for the x-axis, for instance the particular drive belt. Upon analysis, the rotary motion of the displacement pickups forms a measure of the particular distance present and lastly also of the new distance position between the two units.

I claim:

1. A sewing machine for sewing stationary large surface material (13) comprising at least two units (14, 16 and 15, 17), each of said units (14, 16 and 15, 17) including a sewing head (14, 15) and an associated shuttle box (16, 17), means (3) mounting said units for displaceable movement in a first direction (x), said mounting means (3) being displaceable in a second direction (y) substantially normal to said first direction (x), common drive means (18, 19, etc.) for displacing said units simultaneously in the first direction (x) while spaced a predetermined distance (D) from each other, means (35) for disengaging one of said units (14, 16 or 15, 17) from said common drive means (18, 19, etc.) and the other unit is displaced by said common drive means to thereby selectively change said predetermined distance (D), and said disengaging means (35) being further re-engageable relative to said common drive means (18, 19, etc.) to thereby re-engage and retain said one unit fixed relative to said other unit after said predetermined distance (D) has been changed.

2. The sewing machine as defined in claim 1 including means (39, 41; 40, 42) for holding the disengaged one of said units substantially stationary during the displacement of the other unit.

3. The sewing machine as defined in claim 1 including means (36) for selectively controlling the disengagement and re-engagement of said disengaging and re-engaging means (35).

4. The sewing machine as defined in claim 1 wherein said common drive means (18, 19, etc.) include endless belts.

5. The sewing machine as defined in claim 1 wherein said common drive means (18, 19, etc.) include endless belts, and additional drive means (20, 21; 43, 47) for driving said endless belts.

6. The sewing machine as defined in claim 1 wherein said common drive means (18, 19 etc.) include endless belts, the sewing head (14, 15) of said units (14, 16 and 15, 17) being associated with a first (18) of said endless belts, and the shuttle box (16, 17) of said units (14, 16 and 15, 17) being associated with a second (19) of said endless belts.

7. The sewing machine as defined in claim 1 wherein said common drive means (18, 19 etc.) include endless belts, the sewing head (14, 15) of said units (14, 16 and 15, 17) being associated with a first (18) of said endless belts, the shuttle box (16, 17) of said units (14, 16 and 15, 17) being associated with a second (19) of said endless belts, and said disengaging and re-engaging means (35) is associated with each of said sewing heads (14, 15) and each of said shuttle boxes (16, 17).

8. The sewing machine as defined in claim 1 wherein said common drive means (18, 19, etc.) include endless smooth belts.

9. The sewing machine as defined in claim 1 wherein said common drive means (18, 19, etc.) include endless toothed belts.

10. The sewing machine as defined in claim 1 including means (10) for supporting a large surface material (13) generally stationary in a single plane, said sewing heads (14, 15) being located on one side of said single plane, and said shuttle boxes being located on another side of said single plane.

11. The sewing machine as defined in claim 1 including means (10) for supporting a large surface material (13) generally stationary in a single plane, said sewing heads (14, 15) being located on one side of said single plane, said shuttle boxes being located on another side of said single plane, said displaceable mounting means (3) including a frame carrying said units (14, 16 and 15, 17), and means (1, 8 and 2, 9) mounting said frame for displacement in said second direction (y).

12. The sewing machine as defined in claim 1 wherein said drive means (18, 19, etc.) include endless belts, said disengaging and re-engaging means (35) include coupling means (33–37) associated with each sewing head (14, 15) and each shuttle box (16, 17) for selectively effecting disengagement and re-engagement thereof relative to an associated endless belt.

13. The sewing machine as defined in claim 1 wherein said drive means (18, 19, etc.) include endless belts, said disengaging and re-engaging means (35) include coupling means (33–37) associated with each sewing head (14, 15) and each shuttle box (16, 17) for selectively effecting disengagement and re-engagement thereof relative to an associated endless belt, and each of said coupling means (33–37) includes a pair of relatively movable plates (35, 37) between which an associated run of said endless belts (18, 19, etc.) is sandwiched for relative disengagement and re-engagement.

14. The sewing machine as defined in claim 1 wherein said drive means (18, 19, etc.) include endless belts, said disengaging and re-engaging means (35) include coupling means (33–37) associated with each sewing head (14, 15) and each shuttle box (16, 17) for selectively effecting disengagement and re-engagement thereof relative to an associated endless belt, each of said coupling means (33–37) includes a pair of relatively movable plates (35, 37) between which an associated run of said endless belts (18, 19, etc.) is sandwiched for relative disengagement and re-engagement, said endless belts are toothed endless belts, and at least one each of said pair of relatively movable plates is toothed for re-engagement with an associated one of said toothed endless belts.

15. The sewing machine as defined in claim 1 including means (39, 41; 40, 42) for holding the disengaged sewing head (14 or 15) and the disengaged shuttle box (16, 17) of the disengaged one of said units (14, 16 or 15, 17) substantially stationary during the displacement of the other unit.

16. The sewing machine as defined in claim 1 including means (39, 41; 40, 42) for holding the disengaged one of said units substantially stationary during the displacement of the other unit, and said holding means (39, 41; 40, 42) includes magnetic means.

17. The sewing machine as defined in claim 1 including means (39, 41; 40, 42) for holding the disengaged one of said units substantially stationary during the displacement of the other unit, and said holding means (39, 41; 40, 42) includes electromagnetic means.

18. The sewing machine as defined in claim 1 including means (39, 41; 40, 42) for holding the disengaged one of said units substantially stationary during the displacement of the other unit, and said holding means (39, 41; 40, 42) includes magnetic means carried by each of said sewing heads (14, 15) and each of said shuttle boxes (16, 17).

19. The sewing machine as defined in claim 1 including means (39, 41; 40, 42) for holding the disengaged one of said units substantially stationary during the displacement of the other unit, and said holding means (39, 41; 40, 42) includes electromagnetic means carried by each of said sewing heads (14, 15) and each of said shuttle boxes (16, 17).

20. The sewing machine as defined in claim 1 including guide means (25, 26; 27, 28) for guiding the displaceable movement of said sewing heads (14, 15) and said shuttle boxes (16, 17) along generally spaced parallel paths of travel.

21. The sewing machine as defined in claim 1 wherein said displaceable mounting means (3) includes a frame carrying said units (14, 16; 15, 17), said frame includes opposite end portions, and means (39, 41; 40, 42) at a park position (38) at one of said frame opposite end portions for holding the disengaged one of said units substantially stationary at said park position (38) during the displacement of the other unit.

22. The sewing machine as defined in claim 1 wherein said common drive means (18, 19, etc.) have a drive pitch which is utilized to accurately selectively change the predetermined distance.

23. The sewing machine as defined in claim 1 wherein said common drive means (18, 19, etc.) have a drive pitch which is utilized to accurately selectively change the predetermined distance, and said drive pitch is defined by teeth of endless belts (18, 19) which in part define said common drive means (18, 19, etc.).

24. The sewing machine as defined in claim 1 wherein said displaceable mounting means (3) includes a frame defined by a pair of spaced generally parallel crossbeams (6, 7), said sewing heads (14, 15) being carried by one (6) of said crossbeams, and said shuttle boxes (16, 17) being carried by another (7) of said crossbeams.

25. The sewing machine as defined in claim 1 wherein said displaceable mounting means (3) includes a frame defined by a pair of spaced generally parallel crossbeams (6, 7), said sewing heads (14, 15) being carried by one (6) of said crossbeams, said shuttle boxes (16, 17) being carried by another (7) of said crossbeams, and means (10) for supporting a large surface material (13) generally stationary in a single plane between said crossbeams (6, 7).

26. The sewing machine as defined in claim 1 wherein said displaceable mounting means (3) includes a frame defined by a pair of spaced generally parallel crossbeams (6, 7), said sewing heads (14, 15) being carried by one (6) of said crossbeams, said shuttle boxes (16, 17) being carried by another (7) of said crossbeams, means (10) for supporting a large surface material (13) generally stationary in a single plane between said crossbeams (6, 7), and said common drive means (18, 19, etc.) are at least in part carried by each of said crossbeams (6, 7).

27. The sewing machine as defined in claim 1 wherein said displaceable mounting means (3) includes a frame defined by a pair of spaced generally parallel crossbeams (6, 7), said sewing heads (14, 15) being carried by one (6) of said crossbeams, said shuttle boxes (16, 17) being carried by another (7) of said crossbeams, means (10) for supporting a large surface material (13) generally stationary in a single plane between said crossbeams (6, 7), said common drive means (18, 19, etc.) include at least two separate drive members (18, 19), one (18) of said drive members being carried by said one crossbeam (6), and another (19) of said drive members (18, 19) being carried by said another crossbeam (7).

28. The sewing machine as defined in claim 1 wherein said displaceable mounting means (3) includes a frame defined by a pair of spaced generally parallel crossbeams (6, 7), said sewing heads (14, 15) being carried by one (6) of said crossbeams, said shuttle boxes (16, 17) being carried by another (7) of said crossbeams, means (10) for supporting a large surface material (13) generally stationary in a single plane between said crossbeams (6, 7), said common drive means (18, 19, etc.) include at least two separate drive members (18, 19), one (18) of said drive members being carried by said one crossbeam (6), another (19) of said drive members (18, 19) being carried by said another crossbeam (7), and a further drive member (2) drivingly interconnecting said two separate drive members (18, 19) and in part defining said common drive means (18, 19, etc.)

29. The sewing machine as defined in claim 1 wherein said drive means (18, 19, etc.) include endless belts, said disengaging and re-engaging means (35) include coupling means (33-37) associated with each sewing head (14, 15), each shuttle box (16, 17) for selectively effecting disengagement and re-engagement thereof relative to an associated endless belt, and cam follower means (49) for operating said coupling means (33-37).

30. The sewing machine as defined in claim 1 wherein said drive means (18, 19, etc.) include endless belts, said disengaging and re-engaging means (35) include coupling means (33-37) associated with each sewing head (14, 15), each shuttle box (16, 17) for selectively effecting disengagement and re-engagement thereof relative to an associated endless belt, and cam follower means (49) for operating said coupling means (33-37) through linkage means (47, 48, etc.).

31. The sewing machine as defined in claim 1 wherein said drive means (18, 19, etc.) include endless belts, said disengaging and re-engaging means (35) include coupling means (33-37) associated with each sewing head (14, 15), each shuttle box (16, 17) for selectively effecting disengagement and re-engagement thereof relative to an associated endless belt, cam follower means (49) for operating said coupling means (33-37) through linkage means (47, 48, etc.), and said linkage means (47, 48, etc.) include at least two links (47, 48) pivotally connected to each other.

32. The sewing machine as defined in claim 1 including guide means (25, 26; 27, 28) for guiding the displaceable movement of said sewing heads (14, 15) and said shuttle boxes (16, 17) along generally spaced parallel paths of travel, said displaceable mounting means (3) includes a frame defined by a pair of spaced generally parallel crossbeams (6, 7), said sewing heads (14, 15) being carried by one (6) of said crossbeams, and said shuttle boxes (16, 17) being carried by another (7) of said crossbeams.

33. The sewing machine as defined in claim 1 including means (55, 56, etc.) for sensing the distance between said two units (14, 16 and 15, 17) to effect re-engagement means (35) upon the selective change of said predetermined distance.

34. The sewing machine as defined in claim 1 including means (55, 56, etc.) for sensing the distance between said two units (14, 16 and 15, 17) to effect re-engagement of said disengaging and re-engaging means (35) upon the selective change of said predetermined distance, and said sensing means (55, 56, etc.) include a transmitter and a receiver carried by associated ones of said sewing heads (14, 15) and shuttle boxes (16, 17).

35. The sewing machine as defined in claim 1 including means (55, 56, etc.) for sensing the distance between said two units (14, 16 and 15, 17) to effect re-engagement means (35) upon the selective change of said predetermined distance, and said sensing means (55, 56, etc.) include at least a transmitter and a receiver.

36. The sewing machine as defined in claim 1 including means (55, 56, etc.) for sensing the distance between said two units (14, 16 and 15, 17) to effect re-engagement means (35) upon the selective change of said predetermined distance, and said sensing means (55, 56, etc.) include ultrasonic sensors.

37. The sewing machine as defined in claim 1 including means (55, 56, etc.) for sensing the distance between said two units (14, 16 and 15, 17) to effect re-engagement means (35) upon the selective change of said predetermined distance, and said sensing means (55, 56, etc.) include laser sensors.

38. The sewing machine as defined in claim 1 including means (55, 56, etc.) for sensing the distance between said two units (14, 16 and 15, 17) to effect re-engagement means (35) upon the selective change of said predetermined distance, and said sensing means (55, 56, etc.) include rotary actuatable sensors (59).

39. The sewing machine as defined in claim 1 including control means for selectively operating said drive means (18, 19, etc.) to move said one unit to a park position (38) prior to disengaging said one unit from said common drive means (18, 19, etc.), and said control means is further operative for displacing said other unit by said common drive means (18, 19, etc.) only after said one unit is at the park position (38).

40. The sewing machine as defined in claim 1 including control means for selectively operating said drive means (18, 19, etc.) to move said one unit to a park position (38) prior to disengaging said one unit from said common drive means (18, 19, etc.), said control means is further operative for displacing said other unit by said common drive means (18, 19, etc.) only after said one unit is at the park position (38), and means (39, 41; 40, 42) for holding said one unit substantially stationary said park position (38).

41. The sewing machine as defined in claim 1 including control means for selectively operating said drive means (18, 19, etc.) to move said one unit to a park position (38) prior to disengaging said one unit from said common drive means (18, 19, etc.), said control means is further operative for displacing said other unit by said common drive means (18, 19, etc.) only after said one unit is at the park position (38), means (39, 41; 40, 42) for holding said one unit substantially stationary at said park position (38), and means (36) for selectively controlling the disengagement re-engagement of said disengaging ane re-engaging means (35).

* * * * *